US006145616A

United States Patent [19]

Ewanek

[11] Patent Number: 6,145,616

[45] **Date of Patent: *Nov. 14, 2000**

[54] ACOUSTIC CHAMBER

[76] Inventor: Nester Ewanek, 227 Oakside Road S.W., Calgary, Alberta, Canada, T2V 4H7

[ * ] Notice: This patent issued on a continued prosecution application filed under 37 CFR 1.53(d), and is subject to the twenty year patent term provisions of 35 U.S.C. 154(a)(2).

[21] Appl. No.: 08/869,146

[22] Filed: Jun. 4, 1997

[51] Int. Cl.[7] ..... E04F 17/04

[52] U.S. Cl. ..... 181/224; 181/225

[58] Field of Search ..... 181/224, 225, 181/210, 217, 218, 222, 229, 230, 264, 265, 266, 270, 276, 281

[56] References Cited

U.S. PATENT DOCUMENTS

| | | | |
|---|---|---|---|
| 3,219,143 | 11/1965 | Bohanon . | |
| 3,507,356 | 4/1970 | Smith . | |
| 3,511,337 | 5/1970 | Pease et al. | 181/224 |
| 3,895,686 | 7/1975 | Savkar et al. . | |
| 3,960,063 | 6/1976 | Siemes et al. | 181/225 |
| 3,989,415 | 11/1976 | Van-Hee et al. . | |
| 4,146,112 | 3/1979 | Usry . | |
| 4,204,586 | 5/1980 | Hani et al. . | |
| 4,260,037 | 4/1981 | Eline . | |
| 4,264,282 | 4/1981 | Crago . | |
| 4,516,657 | 5/1985 | Allard . | |
| 4,693,339 | 9/1987 | Beale et al. . | |
| 4,729,722 | 3/1988 | Toth . | |
| 4,733,750 | 3/1988 | Poirier et al. . | |
| 4,751,980 | 6/1988 | DeVane | 181/224 |
| 5,125,474 | 6/1992 | Lee et al. . | |
| 5,140,819 | 8/1992 | Napier et al. . | |
| 5,164,552 | 11/1992 | Pandeya et al. . | |
| 5,196,654 | 3/1993 | DiFlora et al. . | |
| 5,326,317 | 7/1994 | Ishizu et al. | 181/224 |
| 5,332,872 | 7/1994 | Ewanek | 181/224 |
| 5,423,395 | 6/1995 | Kieffer . | |
| 5,558,492 | 9/1996 | Kieffer . | |
| 5,625,172 | 4/1997 | Blichmann et al. | 181/224 |

OTHER PUBLICATIONS

Vibron Limited Product Brochure entitled "Rectangular Duct Silencer Selection Procedure", 3 pages, Feb., 1996.

Article entitled "Trapping and Suppressing Compressor Axial Fan Intake Noise" Rod MacDonald, Nester Ewanek, Pat Tilley, 11 pages, undated.

Walker Noise Cancellation Technologies, product information, 15 pages, undated.

Canadian Patent Application No. 2,215,761, filed Sep. 17, 1997.

Hush House Induced Vibrations at the Arkansas Air National Guard Facility, Fort Smith, Arkansas, James C. Battis, AFGL–TR–87–0320, Environmental Research Papers No. 990, Nov. 13, 1987, 4 pages.

IAC Noise Control Reference Handbook, by Martin Hirschorn, Industrial Acoustics Company, pp. 07–08, 1982, 3 pages.

(List continued on next page.)

*Primary Examiner*—Khanh Dang
*Attorney, Agent, or Firm*—Anthony R. Lambert

[57] ABSTRACT

An acoustic chamber for a compressor, wherein the compressor has a cooling fan and a fan opening. The acoustic chamber has a floor, a ceiling and first and second side walls, defining first and second ends of the chamber, one of the ends being open for flow of air into the chamber. An acoustic choke at the second end faces the open end of the chamber and extends between the first and second side walls and between the floor and ceiling. An acoustic channel disposed adjacent the open end of the chamber directs sound in a channelling direction from the open end of the chamber towards the acoustic choke. The floor, ceiling and first and second side walls have sufficient permeability to permit flow of air into the open end of the chamber without negatively affecting the functioning of a compressor cooling fan. The first and second side walls are permeable and each comprises plural parallel side baffles spaced from each other to allow flow of air between the parallel side baffles and extending between the floor and ceiling.

9 Claims, 4 Drawing Sheets-

OTHER PUBLICATIONS

IAC Noishield Aircraft Run–up Pens, Bulletin 2.0018.0, product brochure, 1995, 4 pages.

Acoustical Uses For Perforated Metals, 1986, p. 38.

Vibro–Acoustics product brochure, undated, 1 page.

Acoustics in Recreation Facilities, Design Guidelines, Alberta Recreation & Parks and Alberta Public Works, Supply & Services, K. Kruger, E. Rebke, D. Naffin and B.G. Bagley, revised Feb. 1987, 3 pages.

IAC Quiet–Duct Elbow Silencer product brochure, 1993, 1 page.

VAW Systems, Certified Performance Data, Model 24 ELB–N Low Velocity Elbow Silencer, product brochure, 1993, 2 pages.

Industrial Acoustics Company, Duct Silencers, product brochure, 1988, 3 pages.

HVAC Noise Control?, Vibro–Acoustics product brochure, undated, 3 pages.

ACOUSTIC CHAMBER

FIELD OF THE INVENTION

This invention relates to noise control for cooling fans of gas compressors.

BACKGROUND OF THE INVENTION

Gas pipelines require large compressors to force gas through the pipelines. These compressors may have a fan width of more than 12 feet, and move more than 200,000 cubic feet of air per minute. These compressors and their cooling fans generate significant noise, such that they may create a nuisance for those nearby. For this reason, attempts have been made to make the compressors as quiet as possible, such as by modifying the shapes of the cooling fan blades. However, there are many compressors in existence that are not quiet and that continue to create a nuisance. While the compressors are usually located in isolated areas, continued expansion of residences and decreasing tolerance for environmental noise have created a conflict between existing compressors and people living near them.

It has therefore become desirable to reduce the noise emitted by compressors, and particularly their cooling fans, and it is therefore an object of the present invention to reduce the noise emitted by large compressors.

Noise reduction in large compressors is not an easy task particularly when it is desired to reduce the noise emitted by the air intake of the cooling fan of a compressor. The reason for this is that conventional silencers (as for example used on motor vehicles) create a considerable pressure drop that is unacceptable across the air intake of the cooling fan. With a large pressure drop, air supply is reduced which may result in over heating of the gas being conveyed in the pipeline or of the compressor itself, especially on a hot day (>90° F.). It is therefore a further object of this invention to provide a noise reduction unit for a cooling fan of a compressor unit that allows relatively free flow of air into the cooling fan of the compressor unit.

One design for an acoustic chamber is shown in U.S. Pat. No. 5,332,872 by the same inventor. While this design has had some success, tighter environmental regulations require improved noise control. It is therefore an object of this invention to provide improved noise control for air intakes of gas compressors.

SUMMARY OF THE INVENTION

There is therefore provided in accordance with an aspect of the invention, an acoustic chamber for a cooling fan having a fan opening. The acoustic chamber has side walls defining a chamber having first and second ends, one of the ends being open to allow sound to enter the chamber. An acoustic choke at the second end faces the open end and extends between the side walls. An acoustic channel disposed adjacent the open end directs sound in a channelling direction from the open end towards the acoustic choke. The side walls have sufficient permeability to permit flow of air through the side walls.

In a further aspect of the invention, at least one of the side walls comprises plural parallel side baffles spaced from each other to allow flow of air between the parallel side baffles.

In a further aspect of the invention, an acoustic chamber comprises side walls defining a chamber having open and closed ends. A sound absorbing wall forms the closed end, faces the open end and extends between the side walls. At least one of the side walls comprises plural parallel side baffles spaced from each other to allow flow of air between the parallel side baffles.

In a further aspect of the invention, an acoustic choke comprises an open box shaped enclosure, the enclosure having an open end, and plural columnar baffles spaced apart within the enclosure, oriented perpendicularly to the channelling direction, preferably adjacent the open end of the enclosure.

In a still further aspect of the invention, the acoustic channel comprises plural parallel channel baffles spaced from each other to allow flow of air between the parallel channel baffles. Preferably, the parallel side baffles are oriented perpendicularly to the parallel channel baffles. Also, the channel baffles further from the center of the open end of the chamber are preferably shorter in the channelling direction than parallel channel baffles closer to the center of the open end.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
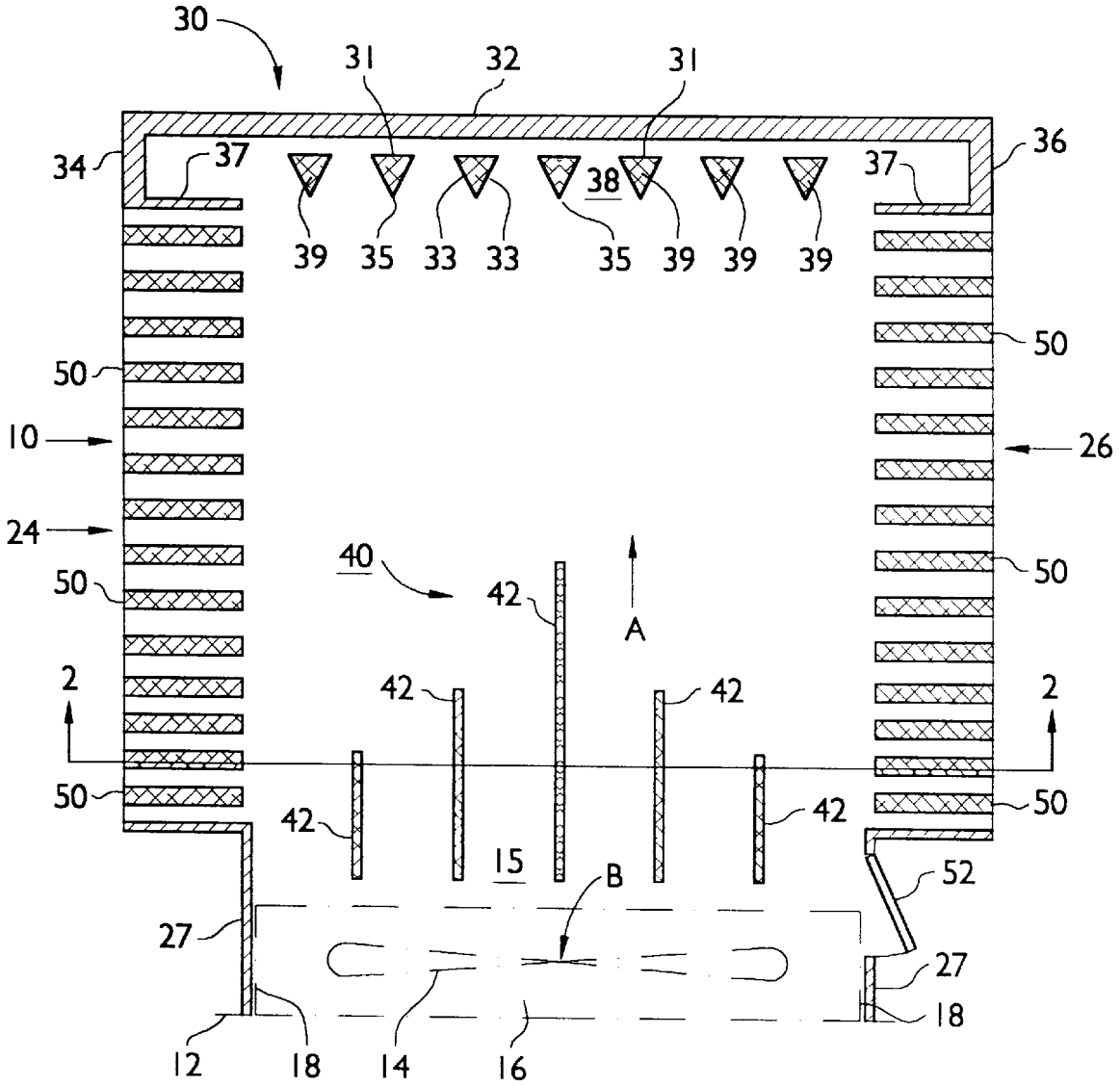
FIG. 1 is a plan view of an acoustic chamber according to the invention with the ceiling removed.
Figure 2:
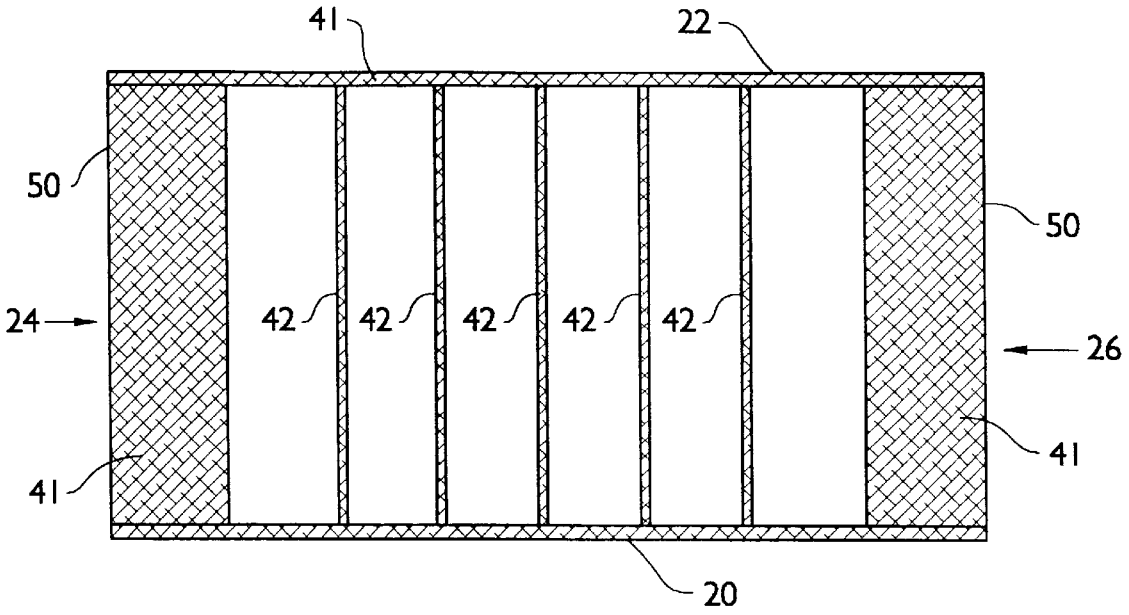
FIG. 2 is a section perpendicular to the plane of FIG. 1 (along the line 2—2 in FIG. 1)

Referring to the figures, an acoustic chamber 10 is shown attached to a conventional compressor building 12. The compressor building 12 has a cooling fan 14 and a fan opening 16. The cooling fan 14 draws air through a coil disposed in the fan opening to cool fluids circulating within the coil. The operation of the fan 14 requires adequate air flow through the fan opening, and for a fan diameter of 13 ft and air opening air speed of 1008 ft/min, the air opening required is about 250 $ft^2$ (at least more than 1½ times the area of the fan opening). The size of air opening required can be readily calculated for any given cooling fan. The walls of the acoustic chamber 10 must be sufficiently permeable to provide close to this size of air opening, otherwise the functioning of the compressor cooling fan will be negatively affected.

The acoustic chamber 10 is preferably attached to the compressor 12 with a flexible sound absorbing joint 18, made for example of Neoprene™, or other flexible, weatherproof, sound absorbing material. The acoustic chamber 10 is formed of a floor 20, a ceiling 22 and first and second permeable side walls 24 and 26 connecting the floor and ceiling on opposite sides of the floor and ceiling to form a chamber having an open end 15 for placement adjacent the fan opening 16. The floor 20 and ceiling 22 are named such since in the common configuration they will be the upper and lower walls of the chamber. However, depending on the orientation of the fan opening, the chamber may have various orientations, such that the floor and ceiling may generally be referred to as side walls of the chamber in the claims. In the detailed description, for convenience, they will be referred to as floor and ceiling.

The walls 24 include impermeable L-shaped segments 27 that extend from the floor 20 to ceiling 22 and attach to the flexible joint 18 to form a conduit for air leading from the opening into the acoustic chamber 10.

An acoustic choke 30 forms a closed end of the chamber and faces the open end 15 and extends between the first and second side walls 24, 26 and between the floor 20 and ceiling 22. The acoustic choke 30 must be spaced from the open end 15 sufficiently to allow the required air flow. The acoustic choke 30 is formed from an open box shaped air impervious sound absorbing enclosure defined by end wall 32 forming the "bottom" of the box with lateral walls 34, 36, the floor 20 and ceiling 22 forming the side walls of the box. The walls 32, 34, 36 and the floor 20 and ceiling 22 are impervious to air. Barrier walls 37 on each side extends inward from the walls 34 and 36 to prevent sound from leaking directly through permeable side walls 24 and 26. The acoustic choke 30 has an open end 38 between the barrier walls 37 facing the fan opening 16. To assist in absorbing sound directed towards the acoustic choke 30 by channelling means 40, wherein the sound is directed in a channelling direction, plural columnar baffles 39 are located within the enclosure of the acoustic choke 30 in a spaced array adjacent the open end 38 and spaced from the end wall 32. The columnar baffles 39 are oriented with their long axis parallel to the end wall 32, perpendicular to the channelling direction. In the exemplary embodiment, the columnar baffles 39 are spaced apart by an amount approximately equal to their width. The baffles 39 extend from the floor 20 to ceiling 22 and are preferably triangular in cross-section with front faces 33 meeting at an apical ridge 35 pointing towards the sound source at the open end 15. Sound is partly absorbed and partly deflected by the triangular baffles 39 into the box shaped enclosure wherein the sound is further absorbed as it reflects off the walls of the enclosure and reverberates within the enclosure.

To prevent sound from leaking directly through the permeable side walls 24 and 26, an acoustic channelling means 40 is disposed adjacent the opening 16 for directing sound in a channelling direction indicated by arrow A from the open end 15 towards the acoustic choke 30. The channelling means 40 forms an acoustic waveguide that guides sound towards the acoustic choke 30.

The channelling means 40 is preferably formed from plural parallel channel baffles 42 spaced from each other to allow flow of air between the parallel channel baffles 42. The parallel channel baffles 42 extend from the floor 20 to the ceiling 22. Channel baffles 42 further from the center B of the open end are shorter in the channelling direction A than channel baffles 42 closer to the center of the open end 15. This allows for maximum air flow, while maximizing directing of sound towards the acoustic choke 30 and away from the permeable side walls 24 and 26.

The side walls 24 and 26 are preferably formed from parallel side baffles 50 spaced from each other to allow flow of air between them and extend between the floor 20 and ceiling 22. The side baffles 50 are arrayed between the barrier walls 37 and wall segments 27 on each side of the acoustic chamber 10. The side baffles 50 are preferably longer in the direction of flow of air between them than the spacing between them, and preferably long enough and sufficiently closely spaced that substantially all sound diffracting around the channelling means 40 impacts with one of the side baffles 50. The parallel side baffles 50 are preferably oriented perpendicularly to the channel baffles. In this perpendicular orientation, the side baffles 50 are preferably spaced further apart from each other with increasing distance from the channelling means 40. This is permitted since straight lines connecting the channelling means 40 to the side baffles 50 furthest from the channelling means 40 are at a greater angle to the side baffles 50 than corresponding lines connecting the channelling means 40 to the side baffles closer to the channelling means 40. Hence, the side baffles 50 can be spaced further apart without sound being able to diffract directly from the end of the channel baffles 42 through the gaps between the side baffles 50. For ease of manufacture, the side baffles 50 have the same length as each other in the direction of flow between them.

An access door 52, for example 2 ft by 2 ft, is provided in wall 27 to allow access to the chamber 10.

For the exemplary embodiment shown, in which the fan opening required is 250 $ft^2$, the following specifications enabled the device to meet strict environmental noise regulations in Canada. The walls 27, 32, 34, 36, 37, floor 20 and ceiling 22 are each formed of an outer jacket (that portion that does not face the inside of the chamber) made of 22 GA profiled galvanized steel and an inner liner (that portion that faces the inside of the chamber) screwed to the outer jacket and made of 22 GA profiled perforated (50%) galvanized steel. The width of the walls 27, 37, floor 20 and ceiling 22 is 3 inches, and the width of the walls 32, 34 and 36 are each 6 inches, and the interiors are filled with insulation 41 such as Fibrex™ 1240 (4#/FT3) insulation or other sound absorbing insulation.

Baffles 39 have an air impervious back face 31 (facing away from the fan opening) made from 22 GA galvanized steel, and two air permeable front faces 33 made from 20 GA perforated (50%) galvanized steel, and are also filled with the same insulation 41 as the walls. The faces of the baffles 39 are each 12 inches wide, and the baffles 39 extend from floor to ceiling, in this exemplary case, about 14.5 ft. The baffles 39 are preferably spaced from the end wall 32, for example by about half of the width of a face of the baffle 39.

The baffles 42 are each 3 inches wide and are made from 20 GA profiled perforated (50%) galvanized steel filled with the same insulation 41 as the walls. The baffles 42 have the same length (floor to ceiling) as the baffles 39, and have lengths in the direction A of 3 ft, 4.5 ft, 7.5 ft, 4.5 ft and 3 ft left to right in the figure respectively.

The baffles 50 are each 6 inches wide and are made from 20 GA profiled perforated (50%) galvanized steel filled with the same insulation 41 as the walls. The baffles 50 have the same length (floor to ceiling) as the baffles 39, and have a length in the direction of flow between them of 3 ft. One manner of making such baffles is shown in U.S. Pat. No. 5,332,872, particularly FIG. 7 thereof. The baffles 42 and 50 may each be made from a single sheet of perforated steel, bent to form a rectangle, and the corners may be strengthened by angle irons.

The exemplary structure shown is 22 ft wide (between outer edges of side walls), 21 ft long (between outer edges of flexible joint 18 and wall 32) and 15.3 ft high (between outer edges of floor 20 and ceiling 22).

In one optional, but not preferred embodiment, the floor or ceiling could be provided with some permeability, but installation of baffles in such a configuration and channelling the sound to the acoustic choke away from the floor and ceiling, makes construction unnecessarily expensive.

Figure 3:
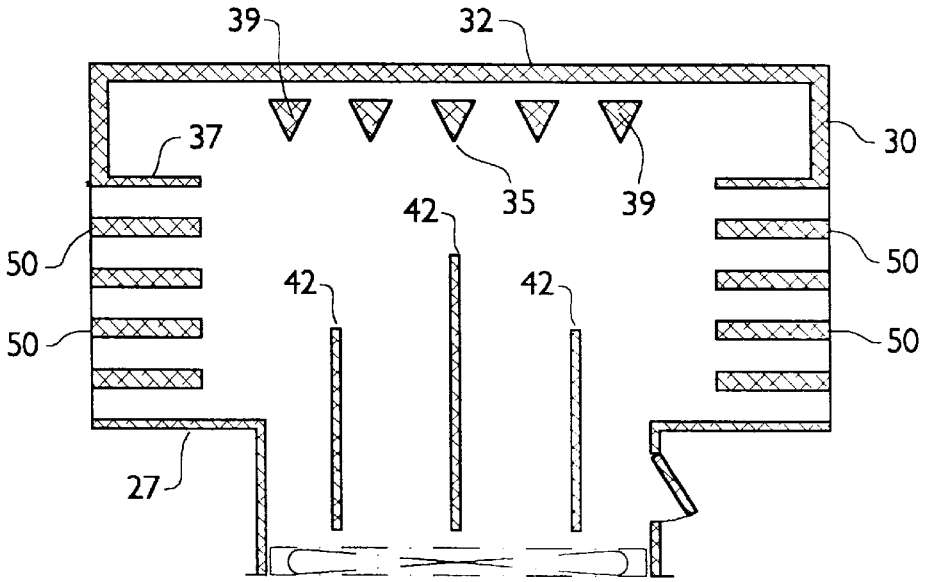
FIG. 3 is a plan view of a second embodiment of an acoustic chamber according to the invention with the ceiling removed.
Figure 4:
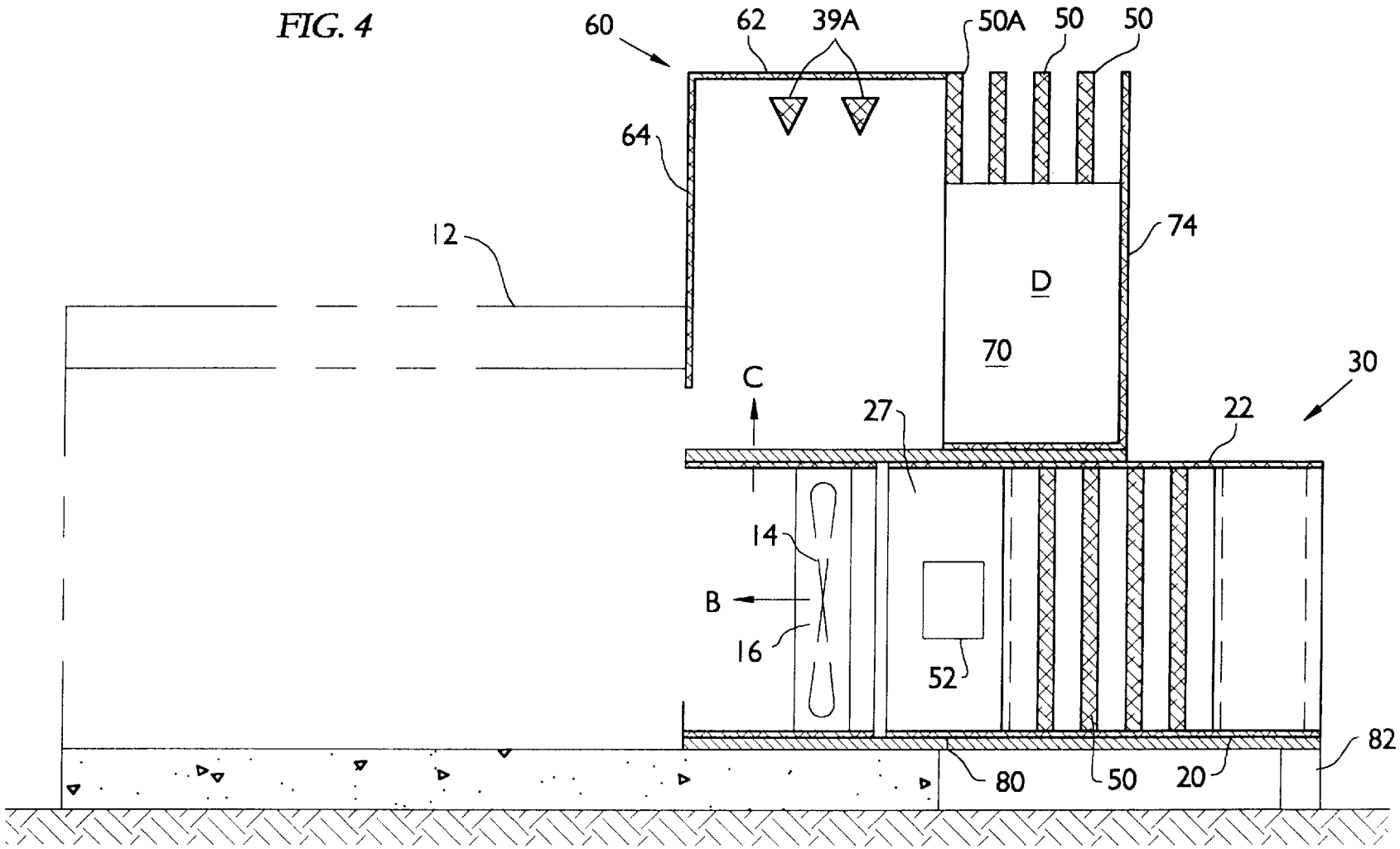
FIG. 4 is a side view of the acoustic chamber of FIG. 3 showing an acoustic chamber for an air outlet.
Figure 5:
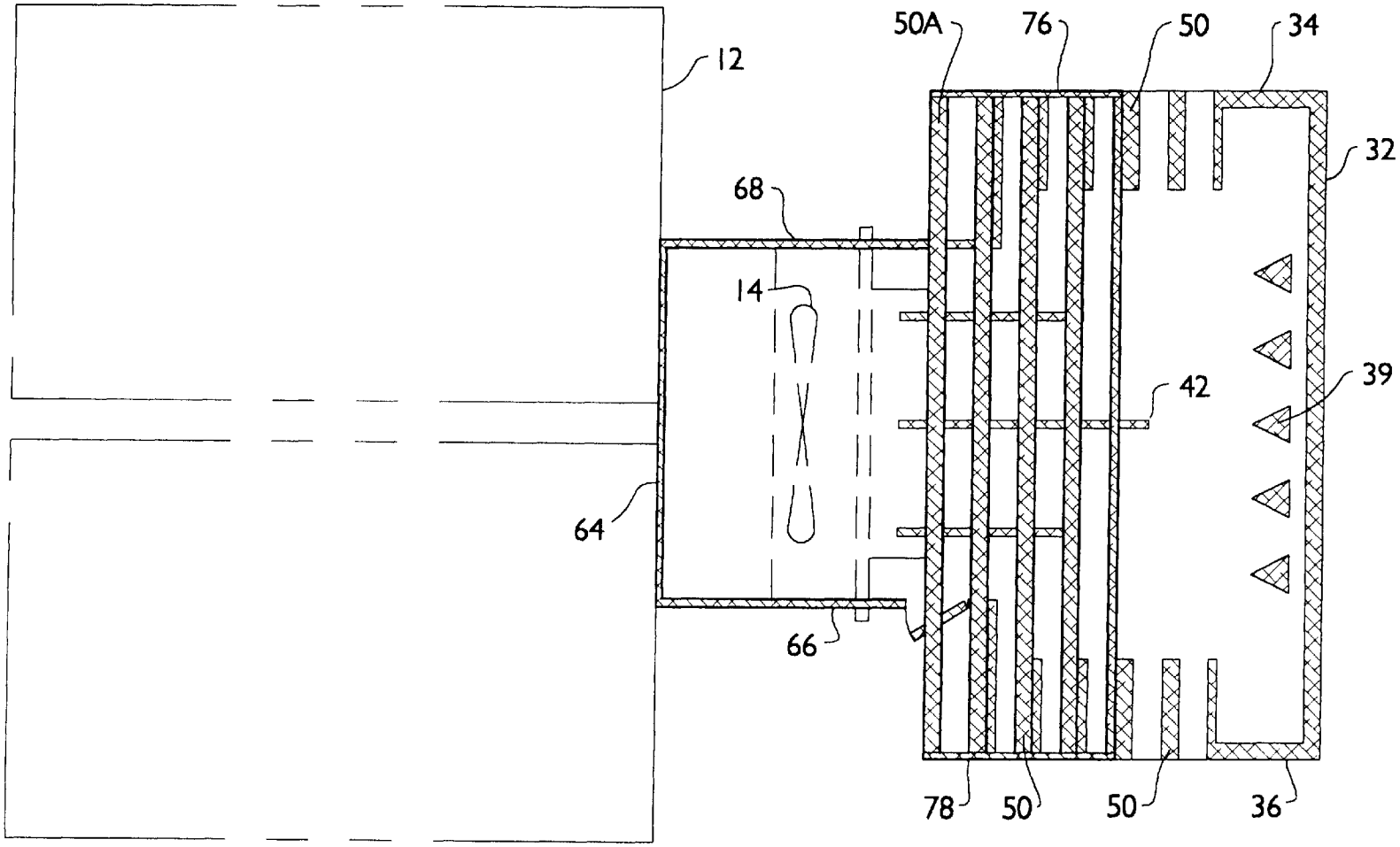
FIG. 5 is a plan view of the acoustic chambers of FIG. 4 with the ceiling of the inlet acoustic chamber removed.

The larger the chamber, the more baffles 42 or 50 are required. FIG. 3 shows an acoustic chamber for a 6 ft fan with three channel baffles 42 and four side baffles 50. The triangular columnar baffles 50 may also be used in an acoustic chamber 60 for an air outlet 62 as shown in FIG. 4. In FIG. 4, air drawn by the cooling fan 14 through fan opening 16 in the direction of arrow B moves upward into the acoustic chamber 60 in the direction C through an opening in the ceiling 22.

The chamber 60 is defined by end wall or ceiling 62 made in the same manner as end wall 32, side wall 64, made in the same manner as end wall 32, and side walls 66, 68, made in the same manner as end wall 32 on either side of the walls 62 and 64. Baffle 50A extends between side walls 66 and 68 and forms a further side wall for an open box shaped sound absorbing enclosure also defined by the walls 62, 64, 66 and 68. Plural columnar baffles 39A are located within the enclosure spaced from the end wall 62. The baffles 39A are made in the same manner and function in the same manner as baffles 39. At outlet 70 below baffle 50A permits air to flow into the area D defined by floor 72, and walls 74, 76 and 78. The ceiling of area D is air permeable, and made from spaced parallel baffles 50 and 50A built in the same manner as the baffles shown in FIG. 1. Air passes from area D through the baffles 50, 50A into the atmosphere. The acoustic choke formed by the enclosure and baffles 39A together with the parallel baffles 50, 50A significantly reduces sound emanating from the cooling fan.

The acoustic chamber 10 is mounted on a receiver frame support 80 and/or jacks 82 at an appropriate height for the air compressor cooling fan, and may be oriented on an upward directed fan opening. Skids may be used for transportation. The acoustic chamber 60 may simply be placed on top of the chamber 10.

A person skilled in the art could make immaterial modifications to the invention described and claimed in this patent without departing from the essence of the invention.

The embodiments of the invention in which an exclusive property or privilege is claimed are defined as follows:

1. An acoustic chamber for a cooling fan having a fan opening, the acoustic chamber comprising:

a floor, a ceiling and first and second side walls forming a chamber having first and second ends, the first end being an open end for placement adjacent an exterior noise source;

at least the first side wall comprising plural parallel insulated side baffles spaced from each other to allow flow of air between the parallel insulated side baffles, the parallel insulated side baffles extending between the floor and ceiling;

the parallel insulated side baffles being elongated in a plane parallel to the roof and ceiling and having a length in the direction of elongation that is greater than the spacing between the parallel insulated side baffles;

the parallel insulated side baffles being placed so that sound energy from the open end impacts with at least one of the parallel insulated side baffles before leaving the acoustic chamber;

an air impermeable wall at the second end, facing the open end and extending across the second end between the first and second side walls and between the floor and ceiling; and the side walls having sufficient permeability to permit flow of air through the side walls.

2. The acoustic chamber of claim 1 further comprising:

at least one center baffle disposed adjacent the open end of the chamber, the center baffle directing sound in a channelling direction from the open end towards the air impermeable wall.

3. The acoustic chamber of claim 2 in which the parallel insulated side baffles are oriented perpendicularly to the center baffle.

4. The acoustic chamber of claim 1 in which the air impermeable wall forms an open box shaped enclosure.

5. The acoustic chamber of claim 3 in which the air impermeable wall forms an open box shaped enclosure.

6. The acoustic chamber of claim 1 in which the parallel insulated side baffles are rectangular in a cross-section parallel to the floor and ceiling.

7. The acoustic chamber of claim 1 in which the second side wall comprises plural parallel insulated side baffles spaced from each other to allow flow of air between the parallel insulated side baffles, the parallel insulated side baffles extending between the floor and ceiling; and the parallel insulated side baffles of the second side wall being elongated and having a length in the direction of air flow between them that is greater than the spacing between them.

8. The acoustic chamber of claim 2 in which the parallel insulated side baffles are rectangular in a cross-section parallel to the floor and ceiling.

9. The acoustic chamber of claim 2 in which the second side wall comprises plural parallel insulated side baffles spaced from each other to allow flow of air between the parallel insulated side baffles, the parallel insulated side baffles extending between the floor and ceiling; and the parallel insulated side baffles of the second side wall being elongated and having a length in the direction of air flow between them that is greater than the spacing between them.

* * * * *